US006185394B1

(12) United States Patent
Lee

(10) Patent No.: US 6,185,394 B1
(45) Date of Patent: Feb. 6, 2001

(54) METHOD OF ADJUSTING PHOTORECEPTOR BELT IN PRINTING APPARATUS

(75) Inventor: Min-soo Lee, Ueiwang (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/456,913

(22) Filed: Dec. 7, 1999

(30) Foreign Application Priority Data

Dec. 7, 1998 (KR) ..... 98-53470

(51) Int. Cl.[7] ..... G03G 15/00
(52) U.S. Cl. ..... 399/116; 399/165
(58) Field of Search ..... 399/110, 116, 399/165

(56) References Cited

U.S. PATENT DOCUMENTS 4,076,409 * 2/1978 Hamaguchi et al. ..... 399/110
4,983,146 * 1/1991 Charles et al. ..... 474/117

FOREIGN PATENT DOCUMENTS 59-83186 * 5/1984 (JP) .
60-186877 9/1985 (JP) ..... G03G/15/00
62-27209 2/1987 (JP) ..... B65G/15/64
8-241014 9/1996 (JP) ..... G03G/21/00
11-161105 * 6/1999 (JP) .

* cited by examiner

*Primary Examiner*—Joan Pendegrass
(74) *Attorney, Agent, or Firm*—Sughrue, Mion, Zinn, Macpeak & Seas, PLLC

(57) ABSTRACT

A method for adjusting a tension applied to a photoreceptor belt in a printing apparatus includes adjusting the tension applied to the photoreceptor belt according to at least three modes including a normal print mode where tension is applied to the photoreceptor belt for a printing operation by pressing the tension roller in a predetermined direction, a loosened tension mode where the tension to the photoreceptor belt is loosened by decreasing the pressure applied to the tension roller during the suspension of the printing operation, and a belt replace mode where the tension to the photoreceptor belt is released to replace the photoreceptor belt, by releasing pressure applied to the tension roller. The mode switching into each mode includes operating a driving motor which drives a tension adjusting unit, to adjust the tension of the photoreceptor belt; detecting the position of the tension adjusting unit; recognizing a mode corresponding to the position of the tension adjusting unit; and stopping the driving motor to stop the operation of the tension adjusting unit if the mode to be switched to is recognized. Therefore, during suspension of the printing operation, the mode can be switched into the loosened tension mode, so that the tension to the photoreceptor belt can be loosened without damage to the photoreceptor belt. As a result, a partial stiffening and folding of the photoreceptor belt at the bent portion thereof can be prevented.

5 Claims, 6 Drawing Sheets

METHOD OF ADJUSTING PHOTORECEPTOR BELT IN PRINTING APPARATUS

BACKGROUND OF THE INVENTION

1. Field of the Invention

The present invention relates to a printing apparatus such as a printer or photocopier, and more particularly, to a method for adjusting the tension applied to a photoreceptor belt that circulates along a predetermined track.

2. Description of the Related Art

In printing apparatuses which are used to form a desired image on a printing paper, a latent electrostatic image is formed on a photoreceptor such as a photosensitive drum or a photoreceptor belt, and developed by a toner of a predetermined color. Then, the developed image is transferred to a printing paper.

FIG. 1 is a schematic view of major elements of a conventional printing apparatus. Referring to FIG. 1, the conventional printing apparatus includes a photoreceptor belt 10, and a driving roller 20, a backup roller 30 and a tension roller 40 which circulate the photoreceptor belt 10 along a given track.

A major charging station 50 for charging the photoreceptor belt 10 is placed over a part of the photoreceptor belt 10. A laser scanning unit (LSU) 60 for emitting a laser beam onto the photoreceptor belt 10 according to an image signal to form a latent electrostatic image thereon, and a development unit 70 for developing the latent electrostatic image with a developer containing a toner of a predetermined color and a liquid carrier, are installed below the photoreceptor belt 10. In general, color printers comprise a plurality of LSU's 60 and a plurality of development units 70 which contain different color developer.

The liquid carrier is removed from the developer which is applied to the photoreceptor belt 10 by a drying roller 81 and a heating roller 82, thereby drying the surface of the photoreceptor belt 10. As a result, a toner image is formed by the toner remains on the latent electrostatic image of the photoreceptor belt 10. The toner image is transferred onto a printing paper 93 by a transfer roller 91 which is installed parallel to the backup roller 30 while the photoreceptor belt 10 is interposed therebetween. The printing paper 93 is supplied between the transfer roller 91 and a pressure roller 92 which is installed parallel to the transfer roller 91, being separated by a predetermined distance, and the toner transferred onto the print paper 93 is heated and pressed by the pressure roller 92, so that the toner is fixed onto the printing paper 93.

Also, the printing apparatus includes a tension adjusting device 100 for adjusting the tension of the photoreceptor belt 10. The tension adjusting device 100 adjusts the tension applied to the photoreceptor belt 10 by applying pressure to the tension roller 40 or releasing pressure therefrom.

FIG. 2 is a perspective view of the tension adjusting device of FIG. 1. The tension adjusting device 10 of FIG. 2 uses a spring 142 and an eccentric cam 150.

In detail, the conventional tension adjusting device 100 includes an auxiliary frame 110 for supporting the tension roller 40 rotatably, and a fixed frame 120 fixed to a main frame 1, and a guide bar 130 for connecting the auxiliary frame 110 and the fixed frame 120.

The auxiliary frame 110 has grooves 111 to which a rotary shaft 41 of the tension roller 40 is coupled, and an elastic plate 112 which covers the installation groove 111 to press the rotary shaft 41 of the tension roller 40. The fixed frame 120 has a hole 121 at the center portion, to which the guide bar 130 is slidably inserted. The guide bar 130 is inserted into the hole 121 to be movable, and one end of the guide bar 130 is coupled to the auxiliary frame 110 by a coupling pin 113. A screw part 131 is formed at the middle portion of the guide bar 130, and is screw-coupled with a nut 141. A spring 142 is installed around the guide bar 130. The eccentric cam 150 that rotates by a driving motor 160, is installed at the other end of the guide bar 130, to control the elastic force applied to the spring 142. Also, a pressing ring 143 is slidably installed around the guide bar 130 such that it can press the spring 142 as the eccentric cam 150 rotates.

In the operation of the tension adjusting device 100 having the above structure, in a normal print mode where the printing apparatus normally operates for printing, the eccentric cam 150 presses the pressing ring 143, so that the guide bar 130 is pushed toward a direction A. Accordingly, the tension roller 40 is moved in the direction A, so that tension is applied to the photoreceptor belt 10. In the case when a worn belt needs to be replaced (referred to as belt replace mode), the pressure applied to the spring 142 is decreased by the rotation of the eccentric cam 150, so that the tension roller 40 moves in a direction B. Accordingly, the tension applied to the photoreceptor belt 10 is released.

As described above, the conventional tension adjusting device 100 is designed to adjust the tension applied to the photoreceptor belt 10 according to two modes: the normal print mode and the belt replace mode. Thus, even when the printing operation stops due to reasons other than the replacement of the photoreceptor belt 10, the tension applied to the photoreceptor belt 10 remains. Also, if the tension applied to the photoreceptor belt 10 is released by switching the normal print mode into the belt replace mode in this case, the photoreceptor belt 10 is loosened and falls down, contacting other units such as the LSU 60 (see FIG. 1) or the development unit 70 (see FIG. 1), installed below the photoreceptor belt 10, causing contamination or damage to the surface of the photoreceptor belt 10.

Meanwhile, in the case when the operation of the printing apparatus stops, if the photoreceptor belt 10 is left for a long time while tension is applied thereto, three bent portions of the photoreceptor belt 10, contacting the driving roller 20, the backup roller 30 and the tension roller 40, are partially stiffened, resulting in folds on the photoreceptor belt 10. As a result, the lifetime of the photoreceptor belt 10 becomes short. Also, such folds on the photoreceptor belt 10 distort the image developed thereon during a printing process, thereby deteriorating the quality in development.

SUMMARY OF THE INVENTION

It is an object of the present invention to provide a method for adjusting the tension of a photoreceptor belt in a printing apparatus, which is capable of appropriately loosening the tension applied to the photoreceptor belt during suspension of a printing operation, thereby preventing partial stiffening of the photoreceptor belt and generation of folds due to the stiffening of the photoreceptor belt.

To achieve the object of the present invention, there is provided a method for adjusting tension applied to a photoreceptor belt in printing apparatuses, the photoreceptor belt circulating while being supported by a plurality of rollers including a tension roller, wherein the tension applied to the photoreceptor belt is adjusted according to at least three modes including a normal print mode where tension is applied to the photoreceptor belt for a printing operation by pressing the tension roller in a predetermined direction, a loosened tension mode where the tension to the photoreceptor belt is loosened by decreasing the pressure applied to the tension roller during the suspension of the printing operation, and a belt replace mode where the tension to the photoreceptor belt is released to replace the photoreceptor belt, by relieving pressure applied to the tension roller.

Preferably, the mode switching into each mode includes the steps of: (a) operating a driving motor which drives a tension adjusting mechanism, to adjust the tension of the photoreceptor belt; (b) detecting the position of the tension adjusting mechanism; (c) recognizing a mode corresponding to the position of the tension adjusting mechanism; and (d) stopping the driving motor to stop the operation of the tension adjusting mechanism if the mode to be switched to is recognized.

In another embodiment of the present invention, the mode switching into each mode includes the steps of: (a) operating a driving motor which drives a tension adjusting mechanism, to adjust the tension of the photoreceptor belt; (b) detecting the load applied to the driving motor; (c) recognizing a mode corresponding to the load to the driving motor; (d) stopping the driving motor to stop the operation of the tension adjusting mechanism if the mode to be switched is recognized.

Therefore, the mode can be switched into a loosened tension mode during suspension of the printing operation, so that the tension applied to the photoreceptor belt can be loosened without damage to the photoreceptor belt, and a partial stiffening of the photoreceptor belt at the bent portions and folding of the photoreceptor belt, due to a partial stiffening of the photoreceptor belt, can be prevented.

BRIEF DESCRIPTION OF THE DRAWINGS

The above object and advantages of the present invention will become more apparent by describing in detail preferred embodiments thereof with reference to the attached drawings in which.

DESCRIPTION OF THE PREFERRED EMBODIMENTS

Figure 3:
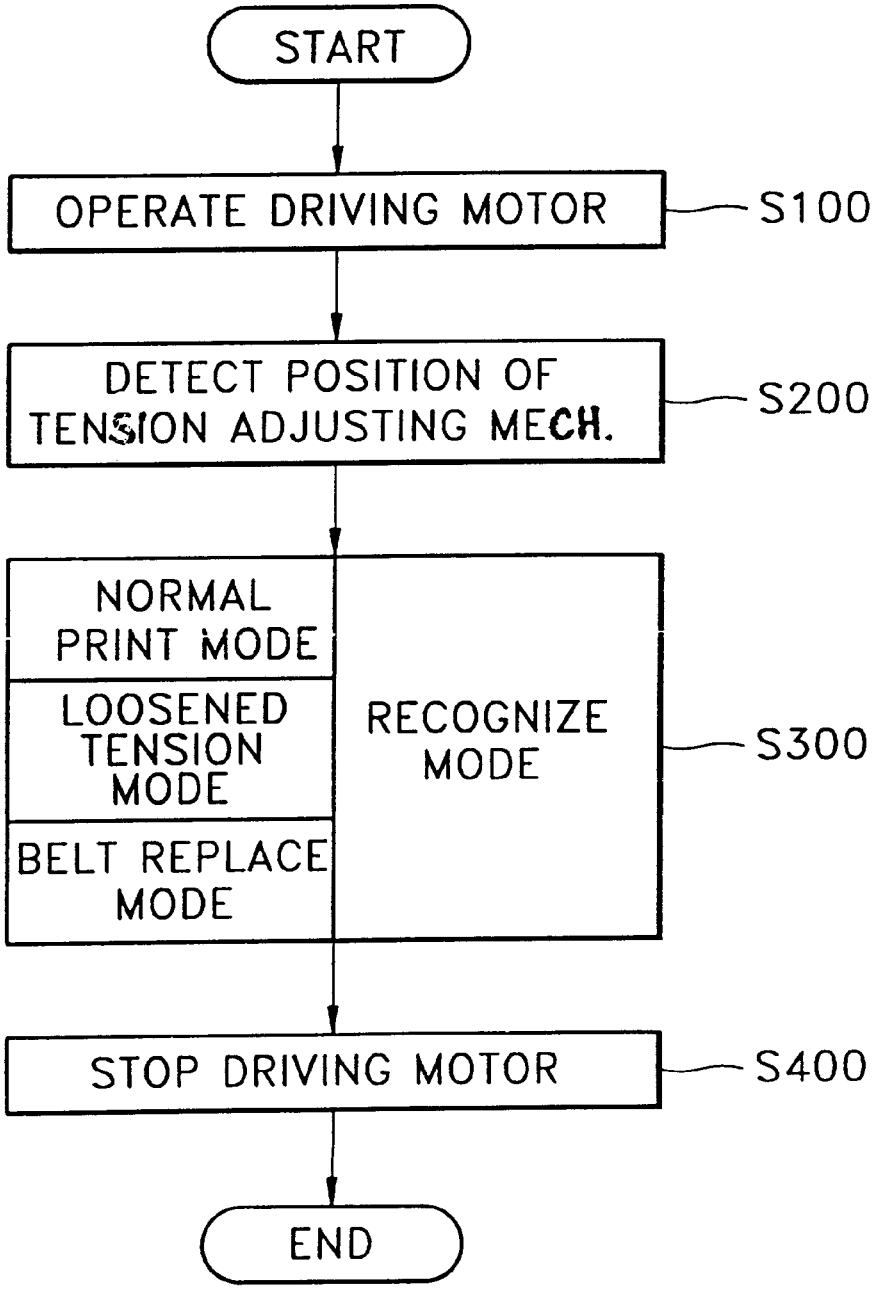
FIG. 3 is a flowchart illustrating a method for adjusting tension applied to a photoreceptor belt for printing apparatuses according to the present invention.

As illustrated in FIG. 3, a method for adjusting tension applied to a photoreceptor belt for printing apparatuses according to the present invention controls the tension applied to the photoreceptor belt according to at least three modes, including a normal print mode where tension is applied to the photoreceptor belt for a printing operation by pressing a tension roller in a predetermined direction, a loosened tension mode where tension to the photoreceptor belt is loosened by decreasing the pressure applied to the tension roller during the suspension of the printing operation, and a belt replace mode where the tension to the photoreceptor belt is released to replace the photoreceptor belt, by decreasing pressure applied to the tension roller.

Figure 4:
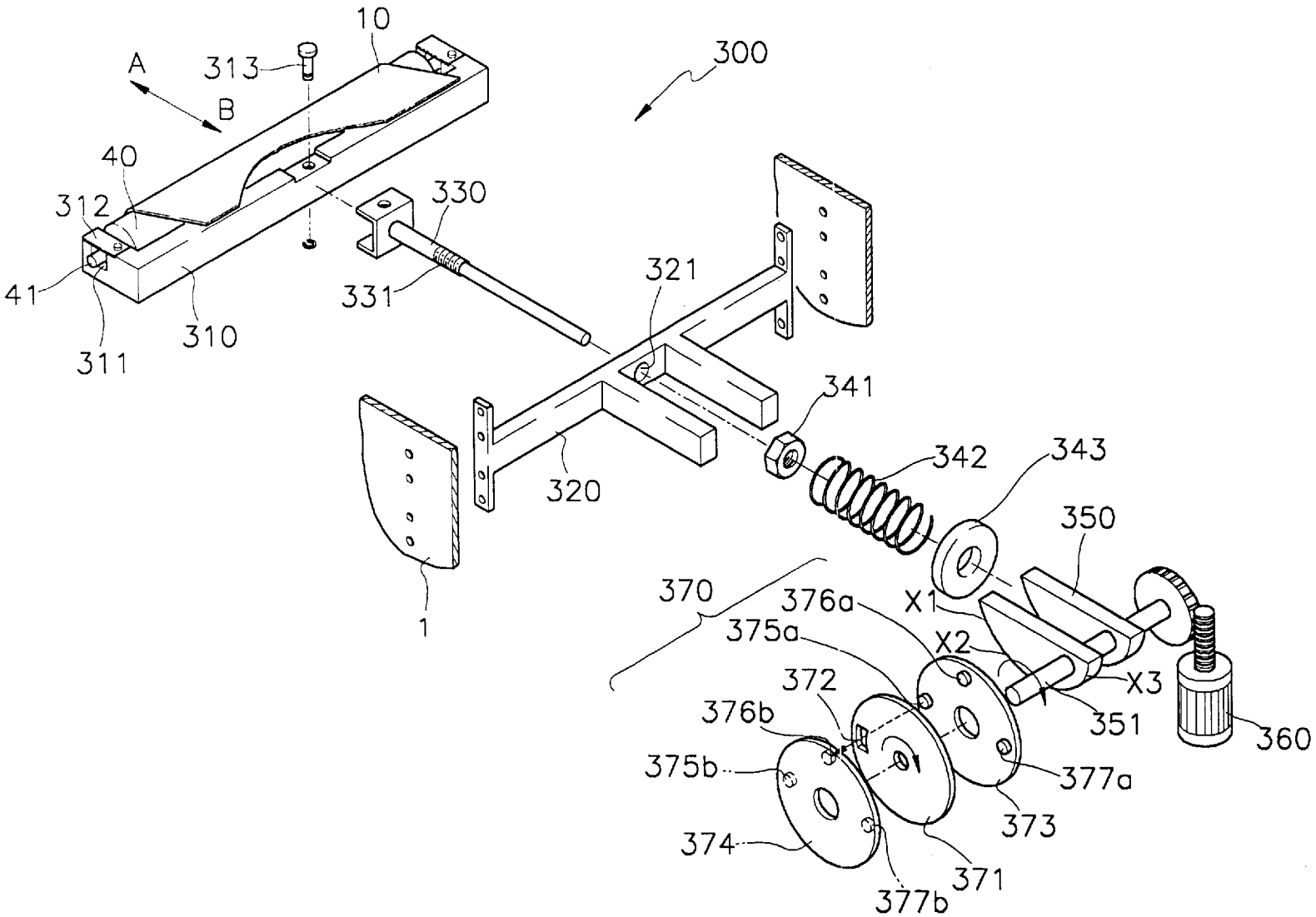
FIG. 4 is a perspective view of a tension adjusting device for the method according to the present invention.

Also, switching into each mode includes the steps of operating a driving motor which drives a tension adjusting device, in order to adjust the tension of the photoreceptor belt (S100); detecting the position of the tension adjusting device (S200); recognizing a mode corresponding to the position of the tension adjusting device (S300); and stopping the driving motor to stop the operation of the tension adjusting device if the mode to be switched is recognized (S400). FIG. 4 is a perspective view of a tension adjusting device by which the tension adjusting method according to the present invention can be implemented. A tension adjusting device 300 for printing apparatuses according to an embodiment of the present invention uses a spring 342 and an eccentric cam 350. The tension adjusting device 300 includes a mechanism for supporting the tension roller 40 of the printing apparatus, a tension adjusting mechanism for applying tension to the photoreceptor belt 10 by pressing the tension roller 40 in a direction, or releasing the tension applied to the photoreceptor belt 10, a driving motor 360 for driving the tension adjusting mechanism, and a mechanism for controlling the driving motor 360.

An auxiliary frame 310 as the supporting mechanism rotatably supports the tension roller 40. A groove 311 in which a rotary shaft 41 of the tension roller 40 is seated, is formed in the auxiliary frame 310. Also, the groove 311 is covered with an elastic plate 312 pressing the rotary shaft 41 of the tension roller 40.

The tension adjusting mechanism includes a fixed frame 320 which is fixed to the main frame 1, and a guide bar 330 for connecting the auxiliary frame 310 and the fixed frame 320. The fixed frame 320 has a hole 321 at the center portion, into which the guide bar 330 is slidably inserted. One end of the guide bar 330 is coupled to the auxiliary frame 310 by a coupling pin 313. A screw part 331 is formed at the middle portion of the guide bar 330, and is screw-coupled with a nut 341. A spring 342 is installed around the guide bar 330. The eccentric cam 350 that rotates by the driving motor 360, is installed at the other end of the guide bar 330, to control the elastic force applied to the spring 342. Also, a pressing ring 343 for pressing the spring 342 with the rotation of the rotating eccentric cam 350 is slidably installed around the guide bar 330. The driving motor 360 rotates the eccentric cam 350 of the tension adjusting mechanism.

The control mechanism controls the driving motor 360 in three modes including a normal print mode, a belt replace mode and a loosened tension mode. That is, during suspension of the printing operation, the driving motor 360 is controlled in the loosened tension mode, to loosen the tension applied to the photoreceptor belt 10. The control mechanism includes a sensing mechanism 370 for sensing the rotation of the rotating eccentric cam 350, and controls the driving motor 360 according to the position of the rotating eccentric cam 350, which is detected by the sensing mechanism when the driving motor 360 operates to switch modes.

The sensing mechanism 370 includes a rotary plate member 371, a slit 372, fixed plate members 373 and 374, and three optical sensors.

The rotary plate member 371 is installed to the rotary shaft 351 of the eccentric cam 350, and rotates by the motor 360 together with the eccentric cam 350. Also, the slit 372 formed at a predetermined portion of the rotary plate member 371 allows the light emitted from the optical sensors to pass the rotary plate member 371. The fixed plate members 373 and 374 are installed at either side of the rotary plate member 371, are separated by a predetermined distance, and the fixed plate members 373 and 374 do not rotate together with the rotary shaft 351. Three optical sensors are installed at each surface of the fixed plate members 373 and 374 facing each other. That is, light emitting portions 375*a*, 376*a*, and 377*a*, of the optical sensors are installed in the fixed member 373, and light receiving portions 375*b*, 376*b*, and 377*b*, are installed in the fixed member 374.

In the operation of the tension adjusting device having the above structure, in the normal print mode, a position X1 of the eccentric cam 350 contacts the pressing spring 343, so that the pressing spring 343 presses against the spring 342, thereby pushing the guide bar 330 in a direction A. Accordingly, the tension roller 40 moves in the direction A, so that tension is applied to the photoreceptor belt 10. In this state, the light emitted from light emitting portion 375*a* of the first optical sensor passes the slit 372 of the rotary plate member 371, and is detected by the light receiving portion 375*b*. However, the lights emitted from the light emitting portions 376*a* and 377*a* of other optical sensors are blocked by the rotary plate member 371, so that they cannot reach the light receiving portions 376*b* and 377*b*. When only the light receiving portion 375*b* of the first optical sensor can detect the light, is the state recognized as a normal print mode.

Figure 1:
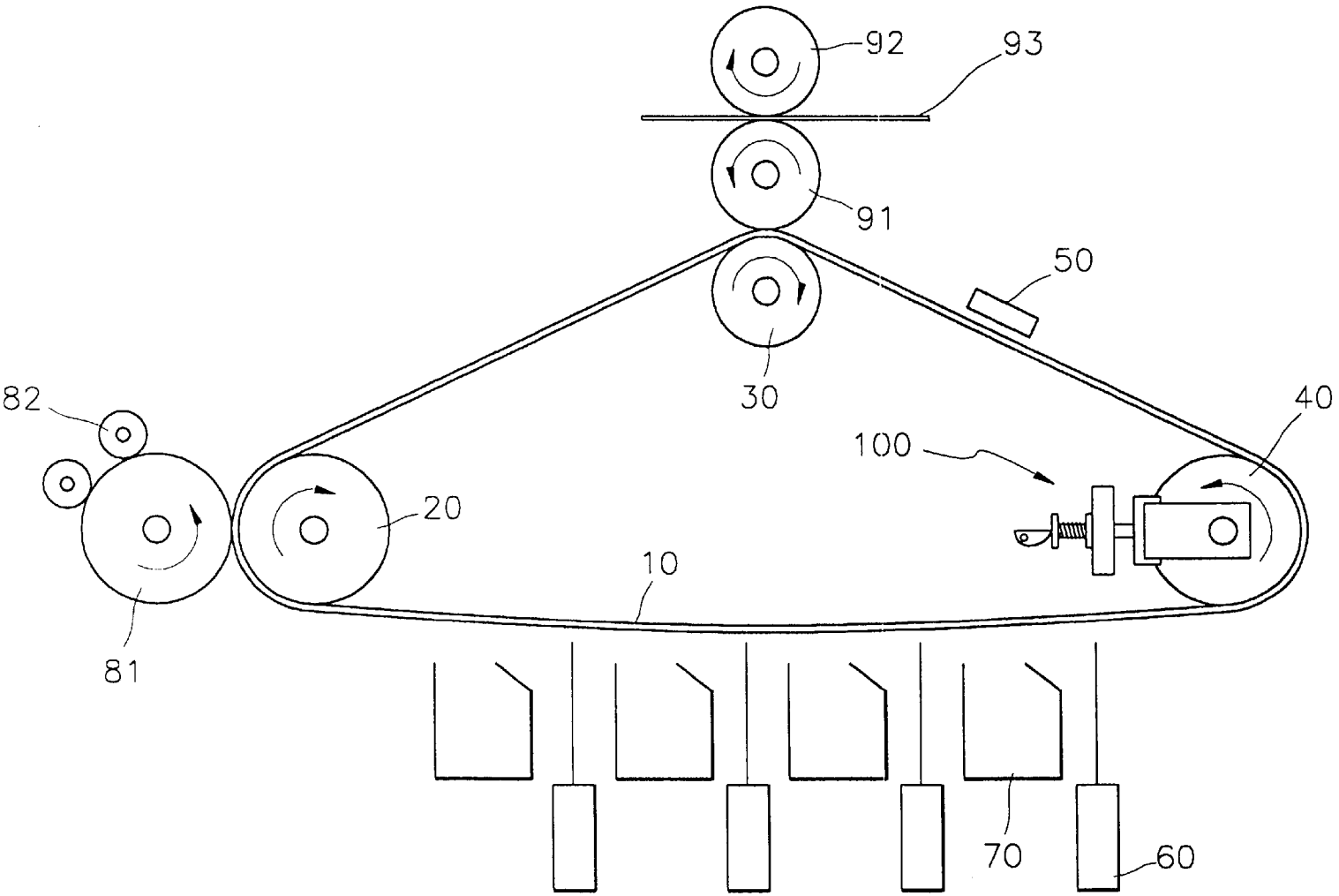
FIG. 1 (PRIOR ART)
FIG. 1 is a schematic view of major elements of a conventional printing apparatus.
Figure 2:
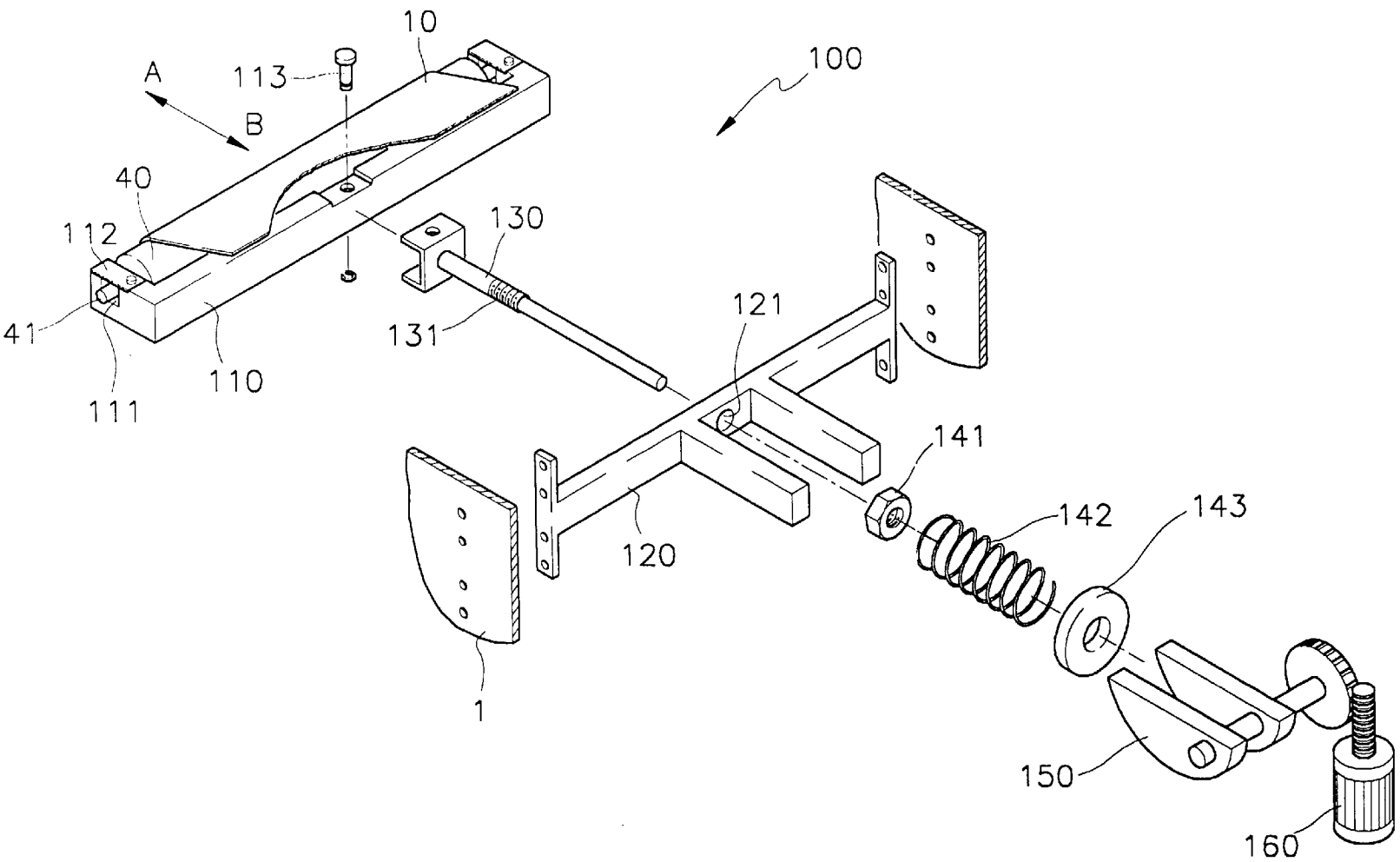
FIG. 2 PRIOR ART
FIG. 2 is a perspective view of the tension adjusting device of FIG. 1.

When the mode is switched to the loosened tension mode due to suspension of the printing operation, the driving motor 360 operates by a printing stop signal, and the eccentric cam 350 and the rotary plate member 371 rotate together. When the eccentric cam 350 rotates a predetermined amount and a portion X2 of the eccentric cam 350 contacts the pressing ring 343, the slit 372 of the rotary plate member 371 is located between the light emitting portion 376*a* and the light receiving portion 376*b* of the second optical sensor. That is, when only the light receiving portion 376*b* of the second optical sensor can detect light, the control mechanism recognizes this state as the loosened tension state, thereby ceasing the operation of the driving motor 360. As a result, the pressure applied to the tension roller 40 is decreased, and the tension roller 40 moves in the direction B by a predetermined amount. Thus, the loosened tension state can be maintained for a while. The position of the portion X2 of the eccentric cam 350 is set such that the photoreceptor belt 10 does not contact other units such as the LSU 60 (see FIG. 1) or the development unit 70 (see FIG. 1) when the photoreceptor belt 10 falls down due to the loosened tension.

In the belt replace mode for replacing a worn photoreceptor belt 10, the eccentric cam 350 rotates a predetermined amount as the driving motor 360 operates, so that a portion X3 of the eccentric cam 350 contacts the pressing ring 343 and the slit 372 of the rotary plate member 371 is located between the light emitting portion 377*a* and the light receiving portion 377*b* of third optical sensor. Only the light receiving portion 377*b* of the third optical sensor can detect light, and the control mechanism recognizes this state as the belt replace mode, thereby ceasing operation of the driving motor 360. In this state, the pressure applied to the spring 342 is removed and the tension roller 40 moves at the end in the direction B, thereby completely releasing the tension applied to the photoreceptor belt 10.

The structure of the sensing mechanism 370 can be modified into various forms. For example, the fixed plate members 373 and 374 may be movably installed on the rotary shaft 351 of the eccentric cam 350 while the rotary plate member 371 is fixed. Alternatively, the sensing mechanism 370 may include only two optical sensors, and the slit is formed to be slightly longer or two slots are formed. In this case, the operation mode can be divided into three according to the state of optical sensors which detect the light, including a first mode where one optical sensor detects light, a second mode where both optical sensors detect light, and a third mode where the other sensor detects light. That is, the sensing mechanism 370 can be implemented with at least two optical sensors and a slit capable of selectively passing light detected by the two optical sensors.

As described above, the tension adjusting device 300 according to the present invention can operate in three modes including the normal print mode, the loosened tension mode, and the belt replace mode, by the control mechanism including the sensing mechanism 370. Thus, during the suspension of the printing operation, the mode is switched into the loosened tension mode, thereby letting loose the tension applied to the photoreceptor belt 10. Thus, the partial stiffening at the bent portions of the photoreceptor belt 10, and folding at those regions can be prevented.

Figure 5:
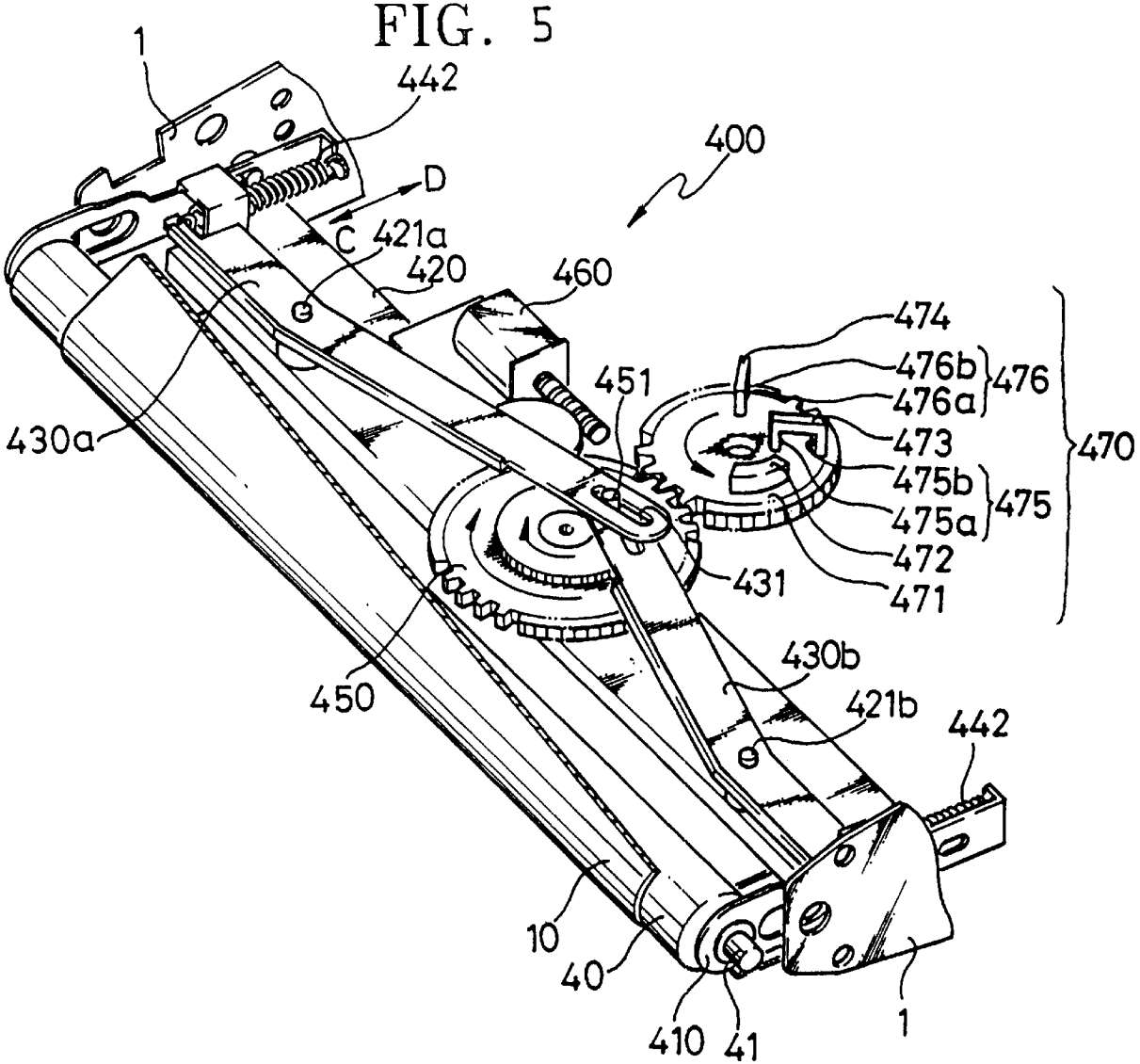
FIG. 5 is a perspective view of another tension adjusting device for the method according to the present invention.

FIG. 5 is a perspective view of another tension adjusting device by which the tension adjusting method according to the present invention can be implemented. In FIG. 5, a tension adjusting device 400 includes a mechanism for supporting a tension roller 40 of the printing apparatus, a tension adjusting mechanism for applying tension to a photoreceptor belt 10 by pressing the tension roller 40, or releasing tension applied to the photoreceptor belt 10, a driving motor 460 for driving the tension adjusting mechanism, and a mechanism for controlling the driving motor 460.

An auxiliary frame 410 as the supporting mechanism is slidably installed in a main frame 1 of the printing apparatus and rotary shaft 41 of the tension roller 40 are rotatably coupled to one end of the auxiliary frame 410.

The tension adjusting mechanism includes a fixed frame 420 that is fixed to the main frame 1, rocking members 430*a* and 430*b* and a circular rotary plate 450 which are installed on the fixed frame 420, and springs 442 each connecting the rocking members 430*a* and 430*b* to the auxiliary frame 410. The middle portions of the rocking members 430*a* and 430*b* are coupled to the fixed frame 420 by hinge pins 421 *a* and 421 *b*, respectively, and each one end of the rocking members 430*a* and 430*b* has a slot 431. The circular rotary plate 450 is rotatably installed on the fixed frame 420, and has a coupling pin 451 protruding at the surface thereof, the coupling pin 451 being coupled with the slots 431 of the rocking members 430*a* and 430*b*. The springs 442 are installed between the other ends of the rocking members 430*a* and 430*b* and the other ends of the auxiliary frame 410, respectively, thereby pressing the auxiliary frame 410 in a direction C. The driving motor 460 is installed on the fixed frame 420 and rotates the circular rotary plate 450 of the tension adjusting mechanism.

The control mechanism, as described in the above example, controls the driving motor 460 in three modes including a normal print mode, a loosened tension mode and a belt replace mode. The control mechanism includes a sensing mechanism 470 for sensing the position of the circular rotary plate 450 and controls the driving motor 460 according to the position of the circular rotary plate 450, sensed by the sensing mechanism 470, as the driving motor 460 operates to switch modes.

The sensing mechanism 470 includes a rotary plate member 471, and a boss 472 and brackets 473 and 474 which are installed in the rotary plate member 471, and optical sensors 475 and 476 respectively installed in the brackets 473 and 474.

The rotary plate member 471 is installed to be rotatable being engaged with the circular rotary plate 450 which rotates by the driving motor 460. The boss 472 formed to protrude at a predetermined portion on the rotary plate member 471 blocks lights emitted from the optical sensors 475 and 476. The brackets 473 and 474 formed on the rotary plate member 471 are separated from each other, and do not rotate. The brackets 473 and 474 have a gate-like shape to allow the revolving boss 472 to pass through the same, and light emitting portions 475*a* and 476*a* and light receiving portions 475*b* and 476*b*, which make up the optical sensors, are respectively installed at the inner side of each of the brackets 473 and 474.

In the operation of the tension adjusting device according to another embodiment of the present invention, in the normal print mode as shown in FIG. 5, the rocking members 430*a* and 430*b* rotate such that the other ends thereof extend in a direction C. Accordingly, the auxiliary frame 410 moves in the direction C by the elastic force of the spring 442, and the tension roller 40 is pushed in the direction C, thereby applying a tension to the photoreceptor belt 10. In this state, the boss 472 of the rotary plate member 471 is located a position where it cannot block light emitted from the light emitting portion 475*a* of the first optical sensor 475 and the light emitting portion 476*a* of the second optical sensor 476. This state, where the light receiving portion 475*b* of the first optical sensor 475 and the light receiving portion 476*b* of the second optical sensor 476 both can detect light, is recognized as a normal print mode.

When the mode is switched into the loosened tension mode due to the suspension of the printing operation, the driving motor 460 operates in response to a printing stop signal, and the rotary plate member 471 rotates together with the rotation of the circular rotary plate 450. When the circular rotary plate 450 rotates clockwise a predetermined amount (approximately 90°), the rocking members 430*a* and 430*b* rotate such that the other ends thereof move toward a direction D, and the auxiliary frame 410 is simultaneously moved in the direction D. As a result, the pressure applied to the tension roller 40 is decreased and the tension roller 40 moves a predetermined distance in the direction D, thereby letting loose the tension applied to the photoreceptor belt 10. The rotary plate member 471 rotates counterclockwise, so that the boss 472 is located between the light emitting portion 475*a* and the light receiving portion 475*b*, blocking light from the light emitting portion 475*a* of the first optical sensor 475. When only the light receiving portion 476*b* of the second optical sensor can detect the light as above, the control mechanism recognizes this state as the loosened tension mode, and stops the operation of the driving motor 460.

When the driving motor 460 operates to switch modes into a belt replace mode to replace the worn photoreceptor belt 10, the circular rotary plate 450 in the normal print mode rotates clockwise by 180°. Accordingly, the other ends of the rocking members 430*a* and 430*b* rotate in the direction D, intervening the movement of the auxiliary frame 410. As a result, the auxiliary frame 410 and the tension roller 40 are sequentially moved to the end of the direction D, thereby completely releasing the tension applied to the photoreceptor belt 10. Here, the rotary plate member 471 rotates counterclockwise, and the boss 472 passes through the first optical sensor 475 and stops between the light emitting portion 476*a* and the light receiving portion 476*b* of the second optical sensor 476 installed in the bracket 474. As a result, light from the light emitting portion 476*a* of the second optical sensor 476 is blocked by the boss 472. When only the light receiving potion 475*b* of the first optical sensor 475 can detect light as above, the control mechanism recognizes this mode as a belt replace mode and stops the operation of the driving motor 460.

The structure of the sensing mechanism 470 performing the above function may be modified into various forms. For example, the first and second optical sensors 475 and 476 can be rotatably installed on the rotary plate member 471 while the boss 472 is fixed over the rotary plate member 471. Alternatively, the boss 472 may be installed on the circular rotary plate 450 without the rotary plate member 471, while the brackets 473 and 474 respectively having the first and second optical sensors 475 and 476 are fixed over the circular rotary plate 450. Also, three optical sensors can be installed to allow each optical sensor to recognize each of three modes. That is, the sensing mechanism 370 may be implemented with two optical sensors and a boss that selectively blocks light from the two optical sensors.

As described above, the tension adjusting device according to another embodiment of the present invention can operate in three modes including the normal print mode, the loosened tension mode and the belt replace mode, by using the control mechanism including the sensing mechanism 470. Thus, as in the first embodiment, a partial stiffening and folding at the bent portions of the photoreceptor belt 10, due to the tension which is continuously applied even when the printing operation temporarily stops, can be prevented.

Figure 6:
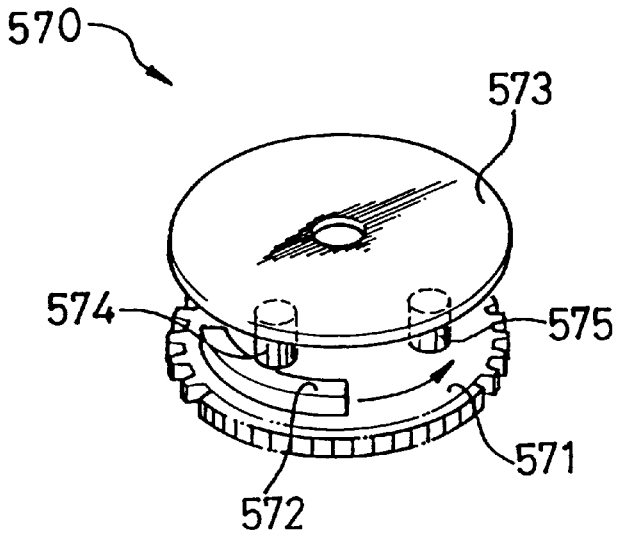
FIG. 6 is a perspective view of another example of the sensing mechanism shown in FIGS. 4 and 5.

FIG. 6 is a perspective view of another example of the sensing mechanism shown in FIGS. 4 and 5. A sensing mechanism 570 comprises a rotary plate member 571, a magnet 572 installed on the rotary plate member 571, a fixed plate member 573 and hall sensors 574 and 575.

The rotary plate member 571 is installed to be rotatable by a driving motor. The magnet 572 having a predetermined length is installed on the rotary plate member 571. The fixed plate member 573 is fixed over the rotary plate member 571, being separated from the rotary plate member 571 by a predetermined distance, and does not rotate, unlike the rotary plate member 571. The hall sensors 574 and 575 are fixed to the fixed plate member 573, being separated from each other by a predetermined distance, facing the magnet 572.

In the sensing mechanism 570, when the magnet 572 passes below the hall sensors 574 and 575 with the rotation of the rotary plate member 571, the hall sensors 574 and 575 detect the passing of the magnet 572 and generates electrical signals. In a normal print mode, only the first hall sensor 574 generates an electrical signal in response to the movement of the magnet 572. Both the first and second hall sensors 574 and 575 generate an electrical signal in a loosened tension mode while only the second hall sensor 575 generates an electrical signal in a belt replace mode. Thus, the sensing mechanism 570 can recognize three modes by the combination of the electrical signals generated by two hall sensors 574 and 575, and control the driving motor for each mode. Thus, the object of the present invention can be achieved.

Figure 7:
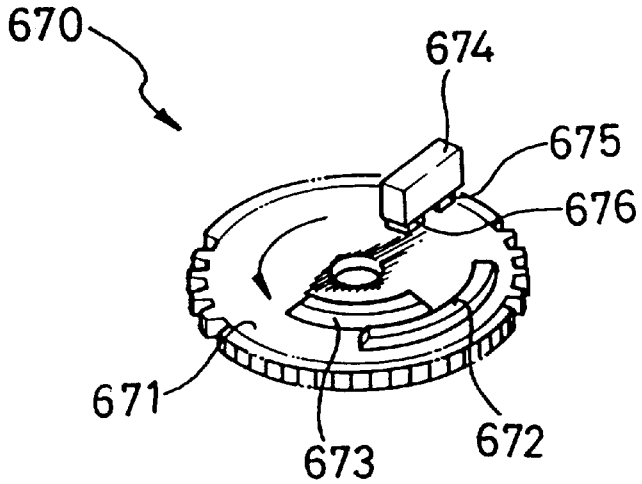
FIG. 7 is a perspective view of still another example of the sensing mechanism shown in FIGS. 4 and 5.

FIG. 7 is a perspective view of still another example of the sensing mechanism shown in FIGS. 4 and 5. A sensing mechanism 670 includes a rotary plate member 671, bosses 672 and 673, and a push button switch 674. The rotary plate member 671 is installed to be rotatable by a driving motor, and two bosses 672 and 673 each having a predetermined length are installed on the rotary plate member 671. The push button switch 674 having two buttons 675 and 676 is fixed over the rotary plate member 671, being separated by a predetermined distance.

The sensing mechanism 670 can recognize three modes by the combination of two bosses 672 and 673 and two buttons 675 and 676 of the push button switch 674. That is, while the first and second bosses 672 and 673 rotate with the rotation of the rotary plate member 671, they selectively interfere with two buttons 675 and 677, which allows the sensing mechanism 670 to recognize three modes. That is, only the first button 675 is interfered with by the first boss 672 in a normal print mode, and both the first and second buttons 675 and 676 are interfered with by the first and second bosses 672 and 673 in a loosened tension mode, respectively. Also, in a belt replace mode, only the second button 676 is interfered with by the second boss 673. The sensing mechanism 670 can recognize three modes by the combination of on/off signals generated by the bush button switch 674 having two buttons 675 and 676, and the control mechanism can control the operation of the driving motor according to the modes.

As still another example of the sensing mechanism, a rotary switch (or mode switch) which is not shown, may be adopted. The rotary switch, a switch for switching the mechanical contact due to the rotation of the rotor into an electrical signal, includes a rotor which is rotatable by a driving motor, and a stator which is fixed facing the rotor. Each of the rotor and the stator are provided with three contact points. The sensing mechanism can recognize three modes as in the above examples according to the contact state of those points which changes as the rotor rotates by the driving motor.

As described above through the examples of the tension adjusting device, the tension adjusting method according to the present invention is characterized by the step of detecting the position of the tension adjusting mechanism for switching into each mode, using the sensing mechanism.

Alternatively, the mode switching step into each mode may include the steps of operating the driving motor that drives the tension adjusting mechanism, to adjust the tension of the photoreceptor belt; detecting the load applied to the driving motor; recognizing the mode to be switched to according to the detected load; and stopping the operation of the tension adjusting mechanism if the mode is recognized.

For example, in the tension adjusting device shown in FIG. 4, the load to the driving motor is the largest in the normal print mode and is the smallest in the belt replace mode. Also, a medium load is applied to the driving motor in the loosened tension mode. Thus, three modes can be recognized by detecting the load applied to the driving motor and the driving motor can be controlled according to the modes. The object of the present invention can be achieved by detecting the load applied to the driving motor.

As described above, in the tension adjusting method according to the present invention, during suspension of the printing operation, the mode can be switched into a loosened tension mode where the tension applied to the photoreceptor belt can be loosened without damage to the photoreceptor belt. Thus, a partial stiffening and folding at the bent portions of the photoreceptor belt can be prevented, improving the development quality and the lifespan of the photoreceptor belt.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method for adjusting a tension applied to a photoreceptor belt in printing apparatuses, the photoreceptor belt circulating while being supported by a plurality of rollers including a tension roller, comprising the step of:

adjusting the tension applied to the photoreceptor belt according to one of at least three modes including a normal print mode where tension is applied to the photoreceptor belt for a printing operation by pressing the tension roller in a predetermined direction, a loosened tension mode where the tension to the photoreceptor belt is loosened by decreasing a pressure applied to the tension roller during suspension of the printing operation, and a belt replace mode where the tension to the photoreceptor belt is released to replace the photoreceptor belt, by releasing the pressure applied to the tension roller;

wherein a mode switching into each of said at least three modes comprises the steps of:

(a) operating a driving motor which drives a tension adjusting means, to adjust the tension of the photoreceptor belt;

(b) detecting a position of the tension adjusting means;

(c) recognizing a mode corresponding to the position of the tension adjusting means; and (d) stopping the driving motor to stop operation of the tension adjusting means if the mode to be switched to is recognized.

2. The tension adjusting method according to claim 1, wherein in the step (b) the position of the tension adjusting means is detected by a sensor operating means installed to be rotatable by the driving motor, and at least two sensors installed are separated from each other by a predetermined distance.

3. The tension adjusting method according to claim 1, wherein in the step (b) the position of the tension adjusting means is detected by at least two bosses which rotate by the driving motor and a push button switch having at least two buttons, the two buttons being selectively interfered with by the bosses.

4. The tension adjusting method according to claim 1, wherein in the step (b) the position of the tension adjusting means is detected by a rotary switch comprising a rotor which is rotatable by the driving motor, and a stator fixed to face the rotor.

5. A method for adjusting a tension applied to a photoreceptor belt in printing apparatuses, the photoreceptor belt circulating while being supported by a plurality of rollers including a tension roller, comprising the step of:

adjusting the tension applied to the photoreceptor belt according to one of at least three modes including a normal print mode where tension is applied to the photoreceptor belt for a printing operation by pressing the tension roller in a predetermined direction, a loosened tension mode where the tension to the photoreceptor belt is loosened by decreasing a pressure applied to the tension roller during suspension of the printing operation, and a belt replace mode where the tension to the photoreceptor belt is released to replace the photoreceptor belt, by releasing the pressure applied to the tension roller;

wherein a mode switching into each of said at least three modes comprises the steps of:

(a) operating a driving motor which drives a tension adjusting means, to adjust the tension of the photoreceptor belt;

(b) detecting a load applied to the driving motor;

(c) recognizing a mode corresponding to the load to the driving motor; and (d) stopping the driving motor to stop operation of the tension adjusting means if the mode to be switched is recognized.

* * * * *